US008555684B1

(12) United States Patent
Chen

(10) Patent No.: US 8,555,684 B1
(45) Date of Patent: Oct. 15, 2013

(54) ELECTRONIC LOCK

(71) Applicant: Jie-Fu Chen, Chiayi (TW)

(72) Inventor: Jie-Fu Chen, Chiayi (TW)

( * ) Notice: Subject to any disclaimer, the term of this patent is extended or adjusted under 35 U.S.C. 154(b) by 0 days.

(21) Appl. No.: 13/745,904

(22) Filed: Jan. 21, 2013

(51) Int. Cl.
*E05B 47/00* (2006.01)

(52) U.S. Cl.
USPC ..... 70/280; 70/223; 70/283.1; 292/142; 292/144

(58) Field of Classification Search
USPC ..... 70/277, 278.7, 189, 190, 275, 280–282, 70/283.1, 217, 218, 222, 223; 292/142, 292/144
See application file for complete search history.

(56) References Cited

U.S. PATENT DOCUMENTS

| | | | | |
|---|---|---|---|---|
| 4,438,962 | A * | 3/1984 | Soloviff et al. | 292/144 |
| 6,032,991 | A * | 3/2000 | Yeh | 292/336.3 |
| 6,062,612 | A * | 5/2000 | Lin | 292/144 |
| 6,418,765 | B1 * | 7/2002 | Chiu | 70/279.1 |
| 6,471,257 | B1 * | 10/2002 | Lu et al. | 292/144 |
| 6,517,127 | B1 * | 2/2003 | Lu et al. | 292/144 |
| 6,585,302 | B2 * | 7/2003 | Lin | 292/142 |
| 6,598,909 | B2 * | 7/2003 | Lu | 292/144 |
| 6,725,693 | B2 * | 4/2004 | Yu et al. | 70/107 |
| 6,758,070 | B2 * | 7/2004 | Yu et al. | 70/107 |
| 7,096,697 | B2 * | 8/2006 | Keightly | 70/279.1 |
| 7,770,423 | B2 * | 8/2010 | Wu | 70/218 |
| 7,827,837 | B2 * | 11/2010 | Huang et al. | 70/277 |
| 7,918,117 | B2 * | 4/2011 | Frolov et al. | 70/431 |
| 8,141,400 | B2 * | 3/2012 | Sorensen et al. | 70/279.1 |
| 8,365,561 | B2 * | 2/2013 | Chang | 70/472 |
| 2003/0209042 | A1 * | 11/2003 | Yeh et al. | 70/280 |
| 2003/0209043 | A1 * | 11/2003 | Yeh et al. | 70/280 |

* cited by examiner

*Primary Examiner* — Suzanne Barrett
(74) *Attorney, Agent, or Firm* — Alan Kamrath; Kamrath IP Lawfirm, P.A.

(57) ABSTRACT

An electronic lock contains a housing including a receiving room, an electronic control device, a connecting portion, a hole, a first touch portion and a second touch portion; a rotary knob including a grip, a shaft, a cross orifice; a C-shaped seat fixed in the receiving room and including an upper extension and a lower extension, the upper extension having a clutch unit, and the clutch unit having a first clutch element and a second clutch element, the first clutch element having a first clutching portion, and the second clutch element having a second clutching portion for retaining with the first clutching portion, the first clutch element having a peg, the lower extension having an aperture; a dual axis motor including two ends having a first pillar and a second pillar; a helical transmitting gear including a stem portion, a helical face, and a protrusion.

2 Claims, 4 Drawing Sheets

ELECTRONIC LOCK

BACKGROUND OF THE INVENTION

1. Field of the Invention

The present invention relates to an electronic lock which has a dual axis motor and a clutch unit connecting with the dual axis motor so as to decelerate and stop rotation.

2. Description of the Prior Art

Conventional electronic lock contains a rotary knob and a grip, and the grip has a shaft extending outwardly from one end surface thereof, and the shaft has a cross orifice defined on a distal end thereof so that the shaft of the rotary knob inserts and rotates a latching head, hence the latching head extends or retracts so as to open or close a doorstop. The electronic lock also contains a motor having a connecting portion for connecting with a driving gear; a helical transmitting gear having a stem disposed on a central position thereof and axially coupling with the shaft of the rotary knob, the transmitting gear having a toothed face formed therearound and meshing with the driving gear, the transmitting gear having a protrusion fixed on a bottom end thereof and driven by the helical transmitting gear, such that the protrusion rotates leftward or rightward to touch a first touch portion or a second touch portion.

Nevertheless, as the motor shifts its rotating direction, it stops immediately to cause overheat because of high-voltage current and breakdown after a period of using time.

The present invention has arisen to mitigate and/or obviate the afore-described disadvantages.

SUMMARY OF THE INVENTION

The primary object of the present invention is to provide an electronic lock which has a dual axis motor and a clutch unit connecting with the dual axis motor so as to decelerate and stop rotation.

An electronic lock provided by the present invention contains:

a housing including a receiving room defined therein, an electronic control device disposed on a top surface of the receiving room, a connecting portion arranged on a bottom end of the electronic control device, a hole defined on a wall thereof adjacent to a bottom end of the housing, a first touch portion and a second touch portion mounted on two sides of the hole;

a rotary knob including a grip, a shaft extending outwardly from one end surface of the grip, a cross orifice formed on a distal end of the shaft, such that the shaft of the rotary knob inserts and rotates the hole of the housing, and the grip abuts against an outer surface of the wall of the housing;

a C-shaped seat fixed in the receiving room of the housing and including an upper extension and a lower extension, the upper extension having a clutch unit secured on a top surface of thereof, and the clutch unit having a first clutch element and a second clutch element, the first clutch element having a first clutching portion, and the second clutch element having a second clutching portion for retaining with the first clutching portion, the first clutch element having a peg disposed on a top surface thereof, the lower extension having an aperture formed on a predetermined position thereof;

a dual axis motor including two ends having a first pillar and a second pillar, the first pillar being coupled with the second clutch element of the clutch unit, and the second pillar being connecting with a helical driving gear;

a helical transmitting gear including a stem portion disposed on a central position thereof and connecting with the shaft of the rotary knob, a helical face formed around the helical transmitting gear for meshing with the helical driving gear, and a protrusion extending outwardly from a bottom end thereof, the protrusion driving the first touch portion and the second touch portion leftward or rightward by rotating the helical transmitting gear.

Thereby, the dual axis motor matches with the clutch unit and shifts its rotating direction smoothly and reverts, thus decelerating and stopping rotation. Accordingly, the dual axis motor does not break and facilitates the operation of the electronic lock.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
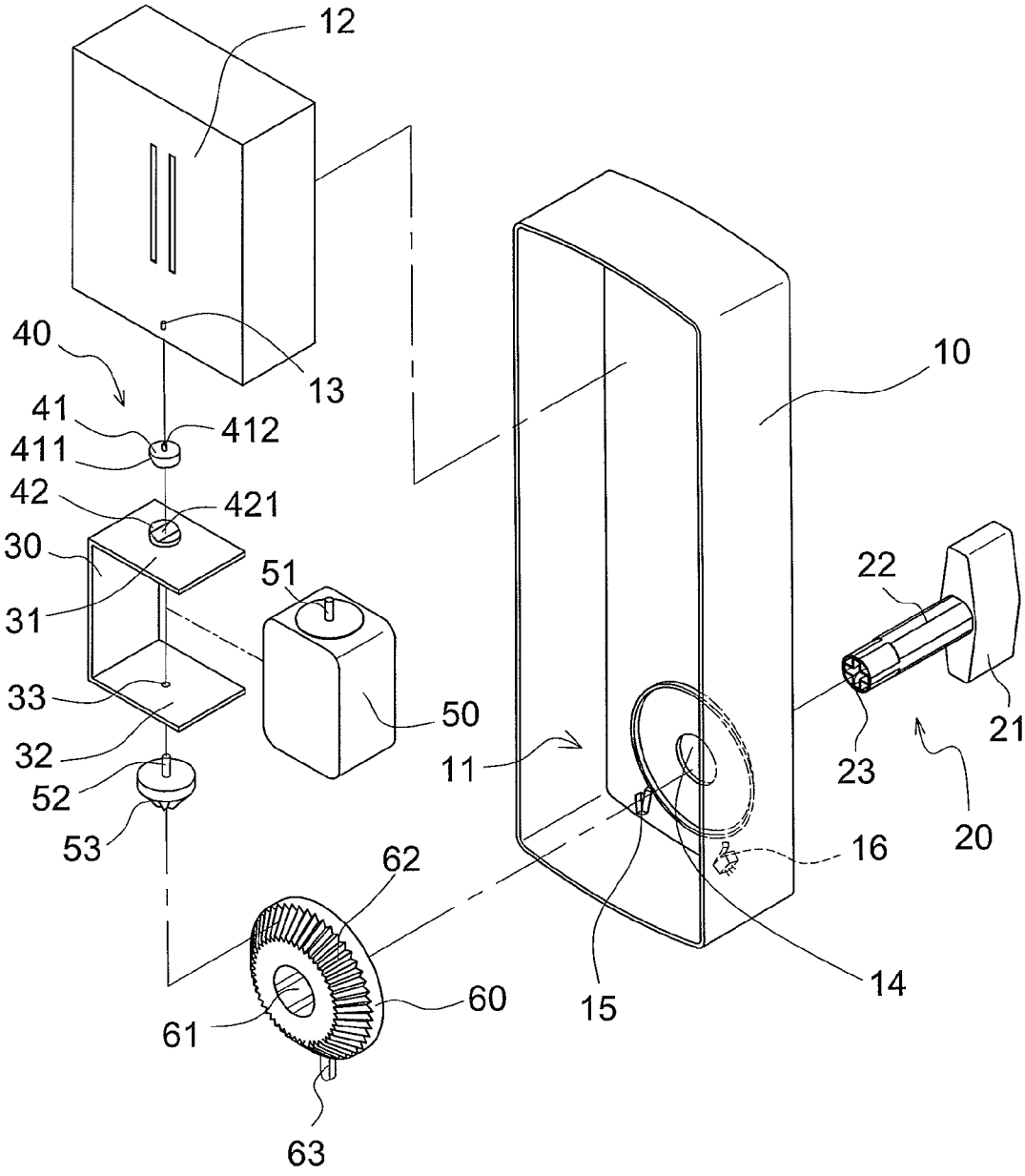
FIG. 1 is a perspective view showing the exploded components of an electronic lock according to a preferred embodiment of the present invention.
Figure 2:
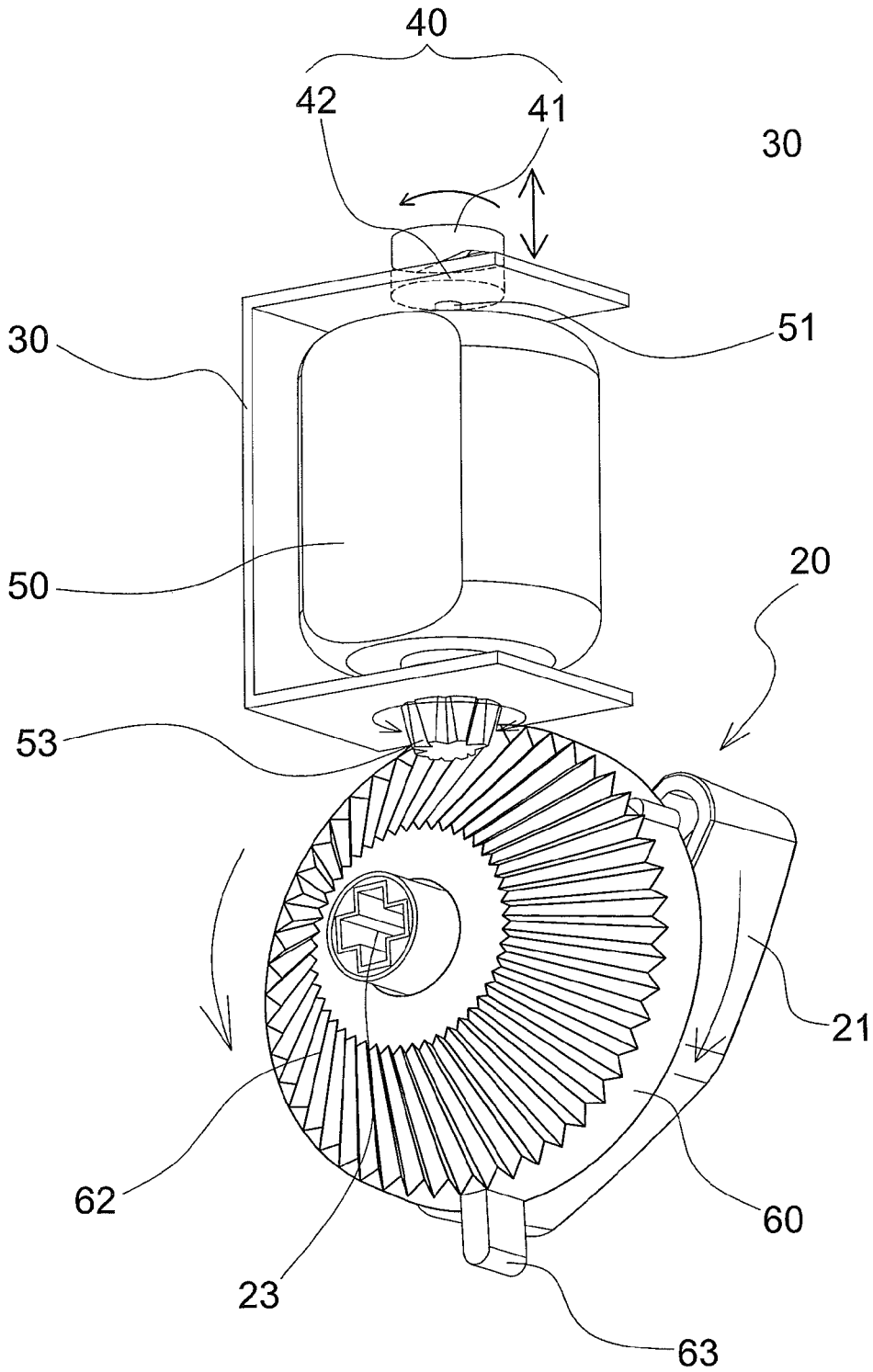
FIG. 2 is a perspective view showing the assembly of the electronic lock according to the preferred embodiment of the present invention.
Figure 3:
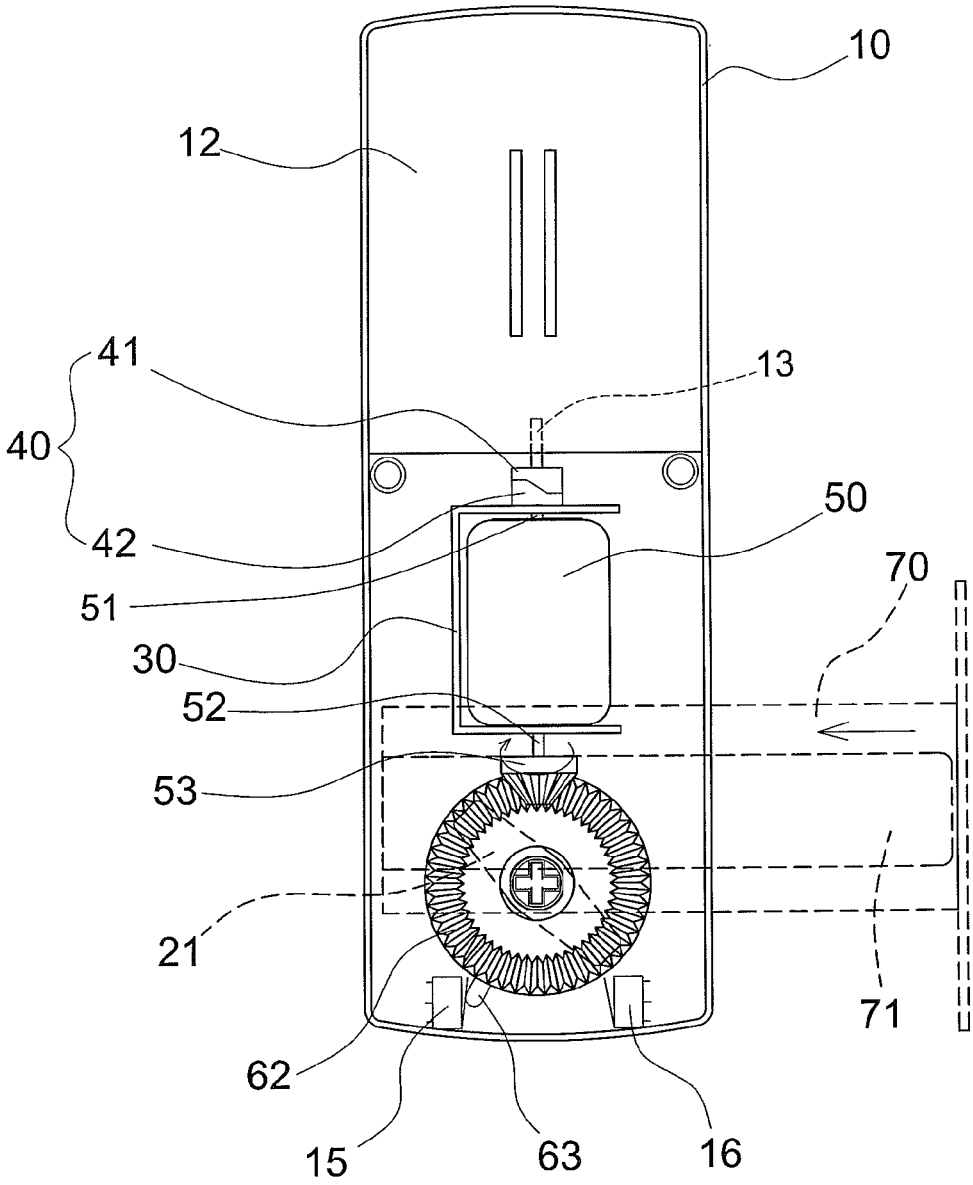
FIG. 3 is a plan view showing the operation of the electronic lock according to the preferred embodiment of the present invention.
Figure 4:
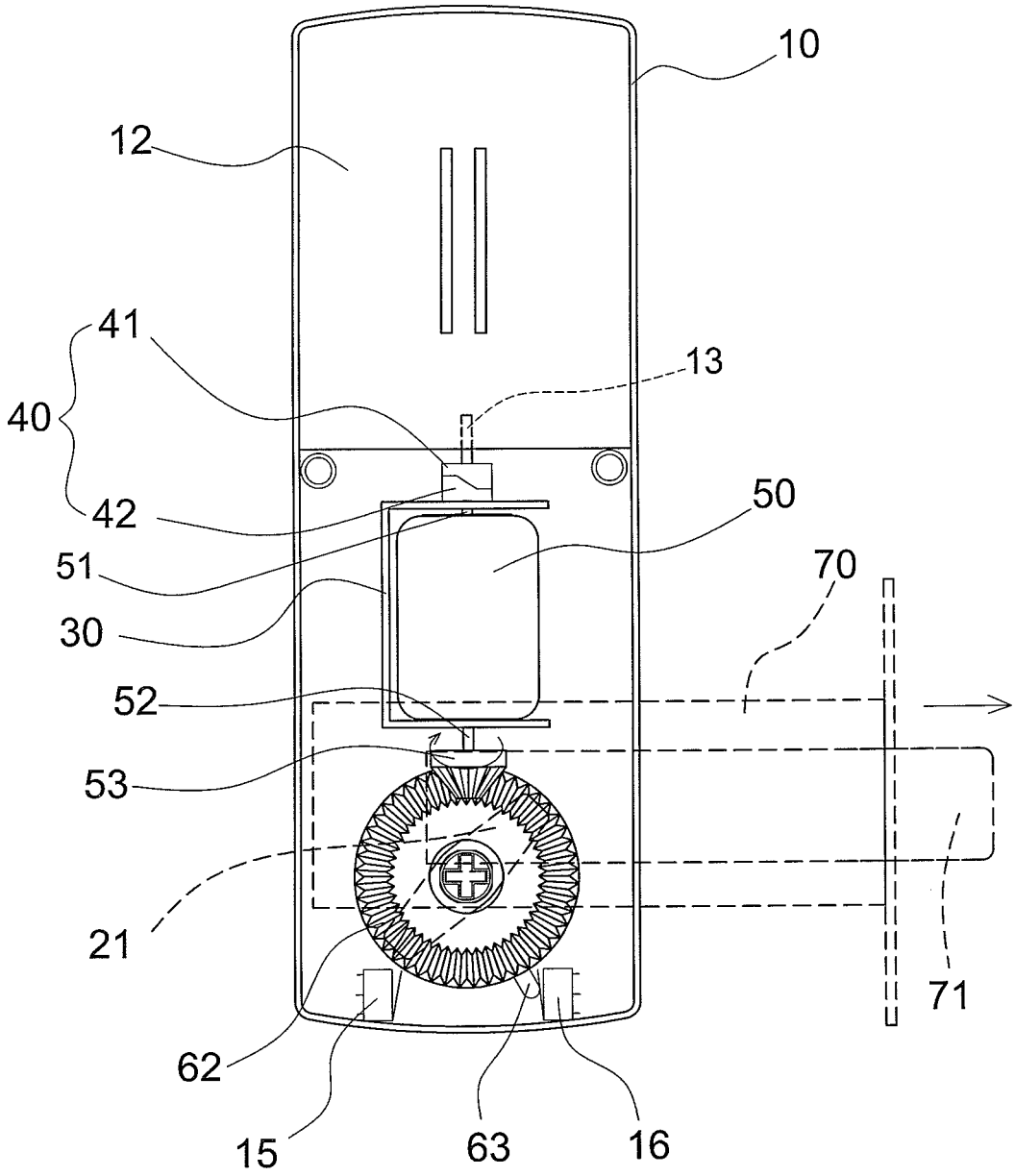
FIG. 4 is another plan view showing the operation of the electronic lock according to the preferred embodiment of the present invention

With reference to FIGS. 1-4, an electronic lock according to a preferred embodiment of the present invention comprises:

a housing 10 including a receiving room 11 defined therein, an electronic control device 12 disposed on a top surface of the receiving room 11, a connecting portion 13 arranged on a bottom end of the electronic control device 12, a hole 14 defined on a wall thereof adjacent to a bottom end of the hole 14, a first touch portion 16 and a second touch portion 15 mounted on two sides of the hole 14;

a rotary knob 20 including a grip 21, a shaft 22 extending outwardly from one end surface of the grip 21, a cross orifice 23 formed on a distal end of the shaft 22, wherein the cross orifice 23 of the rotary knob 20 is used to control a latching head 71 of a latch 70 so that the shaft 22 of the rotary knob 20 inserts and rotates in the hole 14 of the housing 10, and the grip 21 abuts against an outer surface of the wall of the housing 10;

a C-shaped seat 30 fixed in the receiving room 11 of the housing 10 and including an upper extension 31 and a lower extension 32, the upper extension 31 having a clutch unit 40 secured on a top surface of thereof, and the clutch unit 40 having a first clutch element 41 and a second clutch element 42, the first clutch element 41 having a first clutching portion 411, and the second clutch element 42 having a second clutching portion 421 for retaining with the first clutching portion 411, the first clutch element 41 having a peg 412 disposed on a top surface thereof, the lower extension 32 having an aperture 33 formed on a predetermined position thereof, such that a dual axis motor 50 rotates forward by using the clutch unit 40 and reverts, thus decelerating and stopping so as to rotate backward;

the dual axis motor 50 including two ends having a first pillar 51 and a second pillar 52, the first pillar 51 being coupled with the second clutch element 42 of the clutch unit 40, and the second pillar 52 being connecting with a helical driving gear 53;

a helical transmitting gear 60 including a stem portion 61 disposed on a central position thereof and connecting with the shaft 22 of the rotary knob 20, a helical face 62 formed around the helical transmitting gear 60 for meshing with the helical driving gear 53, and a protrusion 63 extending outwardly from a bottom end thereof, the protrusion 63 driving the first touch portion 16 and the second touch portion 15 leftward or rightward by rotating the helical transmitting gear 60.

In operation, as a user controls the latching head 71 to open in a remote control mode, the electronic control device 12 controls the dual axis motor 50 to rotate forward, such that the dual axis motor 50 drives the helical driving gear 53 so that the helical transmitting gear 60 is driven by the helical driving gear 53, and then the helical transmitting gear 60 drives the shaft 22 to control the cross orifice 23 in a multi-segment control manner, by which the cross orifice 23 drives the latching head 71 to open (i.e., to retract). In the meantime, the protrusion 63 of the helical transmitting gear 60 touches the first touch portion 16 so that the first touch portion 16 transmits a signal to the electronic control device 12 by which the clutch unit 40 is controlled to drive the dual axis motor 50, thus decelerating and stopping rotation. Thereafter, the latching head 71 is about to rotate backward. On the contrary, as the user controls the latching head 71 to close in the remote control mode, the electronic control device 12 controls the dual axis motor 50 to rotate backward, such that the dual axis motor 50 drives the helical driving gear 53 so that the helical driving gear 53 drives the helical transmitting gear 60, and then the helical transmitting gear 60 drives the shaft 22 to control the cross orifice 23 in the multi-segment control manner, by which the cross orifice 23 drives the latching head 71 to close (i.e., to extend). In the meantime, the protrusion 63 of the helical transmitting gear 60 touches the second touch portion 15 so that the second touch portion 15 transmits a signal to the electronic control device 12 by which the clutch unit 40 is controlled to drive the dual axis motor 50, thus decelerating and stopping. Thereafter, the latching head 71 is about to rotate forward.

Thereby, the dual axis motor 50 matches with the clutch unit 40 and shifts its rotating direction smoothly and reverts, thus decelerating and stopping rotation. Accordingly, the dual axis motor 50 does not break and facilitates the operation of the electronic lock.

While we have shown and described various embodiments in accordance with the present invention, it is clear to those skilled in the art that further embodiments may be made without departing from the scope of the present invention.

What is claimed is:

1. An electronic lock comprising:

a housing including a receiving room defined therein, an electronic control device disposed on a top surface of the receiving room, a connecting portion arranged on a bottom end of the electronic control device, a hole defined on a wall thereof adjacent to a bottom end of the housing, a first touch portion and a second touch portion mounted on two sides of the hole;

a rotary knob including a grip, a shaft extending outwardly from one end surface of the grip, a cross orifice formed on a distal end of the shaft, such that the shaft of the rotary knob inserts and rotates in the hole of the housing, and the grip abuts against an outer surface of the wall of the housing;

a C-shaped seat fixed in the receiving room of the housing and including an upper extension and a lower extension, the upper extension having a clutch unit secured on a top surface of thereof, and the clutch unit having a first clutch element and a second clutch element, the first clutch element having a first clutching portion, and the second clutch element having a second clutching portion for retaining with the first clutching portion, the first clutch element having a peg disposed on a top surface thereof, the lower extension having an aperture formed on a predetermined position thereof;

a dual axis motor including two ends having a first pillar and a second pillar, the first pillar being coupled with the second clutch element of the clutch unit, and the second pillar being connecting with a helical driving gear;

a helical transmitting gear including a stem portion disposed on a central position thereof and connecting with the shaft of the rotary knob, a helical face formed around the helical transmitting gear for meshing with the helical driving gear, and a protrusion extending outwardly from a bottom end thereof, the protrusion driving the first touch portion and the second touch portion leftward or rightward by rotating the helical transmitting gear.

2. The electronic lock as claimed in claim 1, wherein the cross orifice of the rotary knob drives a latching head of a latch to open or close.

* * * * *